US008499950B2

(12) United States Patent
Win

(10) Patent No.: US 8,499,950 B2
(45) Date of Patent: Aug. 6, 2013

(54) TAMPER EVIDENT CLOSURE

(76) Inventor: Christopher Campbell Win, Hibiscus Coast (NZ)

( * ) Notice: Subject to any disclaimer, the term of this patent is extended or adjusted under 35 U.S.C. 154(b) by 25 days.

(21) Appl. No.: 13/187,069

(22) Filed: Jul. 20, 2011

(65) Prior Publication Data

US 2012/0018401 A1 Jan. 26, 2012

(30) Foreign Application Priority Data

Jul. 23, 2010 (NZ) ..... 586982

(51) Int. Cl.
*B65D 41/34* (2006.01)
*B65D 41/32* (2006.01)

(52) U.S. Cl.
USPC ..... 215/252; 220/266

(58) Field of Classification Search
USPC ..... 215/252, 253, 258, 250, 200; 220/266, 220/265, 276, 319, 320, 200; 264/293
IPC ..... B65D 41/34,41/32
See application file for complete search history.

(56) References Cited

U.S. PATENT DOCUMENTS

| | | | | | |
|---|---|---|---|---|---|
| 2,864,521 | A | * | 12/1958 | Kundert | 215/252 |
| 4,322,012 | A | * | 3/1982 | Conti | 215/344 |
| 4,337,870 | A | | 7/1982 | Keeler | |
| 4,687,114 | A | * | 8/1987 | Crisci | 215/256 |
| 4,784,281 | A | | 11/1988 | Rozenberg | |
| 5,307,945 | A | | 5/1994 | Hidding et al. | |
| 5,346,082 | A | * | 9/1994 | Ochs et al. | 215/252 |
| 5,607,075 | A | * | 3/1997 | Burgdorf et al. | 220/319 |
| 5,829,613 | A | * | 11/1998 | Wohlgemuth et al. | 215/256 |
| 5,913,437 | A | * | 6/1999 | Ma | 215/252 |
| 5,979,682 | A | * | 11/1999 | Zumbuhl | 215/252 |
| 6,325,226 | B1 | * | 12/2001 | Krautkramer | 215/252 |
| 2001/0027957 | A1 | * | 10/2001 | Kano | 215/341 |
| 2002/0033374 | A1 | * | 3/2002 | Ma | 215/252 |
| 2004/0060893 | A1 | * | 4/2004 | Kano et al. | 215/344 |
| 2006/0138073 | A1 | * | 6/2006 | Ooka et al. | 215/344 |

FOREIGN PATENT DOCUMENTS

| | | |
|---|---|---|
| GB | 2 265 890 | 10/1993 |
| GB | 2 268 169 | 1/1994 |
| WO | WO 94/26609 | 11/1994 |

* cited by examiner

*Primary Examiner* — Robert J Hicks
(74) *Attorney, Agent, or Firm* — Young & Thompson

(57) ABSTRACT

A tamper evident closure (TEC) includes a closure cap and at least one tamper evident ring forming a recessed space therein. The ring has a body attached by at least one frangible bridge member to the cap. The ring includes at least one protrusion member spaced there around such that the protrusion members are formed by being stamped to protrude into the recessed space. There is also a related protrusion member forming apparatus. The apparatus includes a base end and a forming end. The forming end includes shaped protuberances which during use cause a stamping or deforming action with respect to a holding action on an inner ring member and outer ring member of a tamper evident ring of a tamper evident closure, to form the protrusion members in the inner ring member. There is also a method of manufacture of a tamper evident closure (TEC).

11 Claims, 11 Drawing Sheets

Section A-A

Section B-B

Section C-C
D-D

Section D-D

Section E-E

Section F-F

Section G-G

Section H-H

Section I-I

Section J-J

Section K-K

TAMPER EVIDENT CLOSURE

The invention relates to a tamper evident closure, an apparatus for forming a tamper evident closure (TEC) and a method of forming a tamper evident closure. The invention is directed particularly but not solely towards consumer products ranging from tamper evident tablet containers to tamper evident water bottles.

BACKGROUND OF INVENTION

Tamper evident closures (TEC's) are designed to provide some evidence of unauthorized opening of any contained goods such as tablets. Traditionally these containers are produced with a closure cap and tamper evident means to hold various consumer products whereby a potential user of the container can tell if the container has already been opened or unsealed. Typically these types of containers are used to hold medicines in tablet form and the container and tamper evident closure are formed from a polymer plastics material by an injection moulding technique process or by a thermoforming process. There are also many other types of containers that use or need TEC's as well as tablet containers.

A TEC is formed including a cap with a thread and catching or locking means and a removable tamper evident ring joined to the cap by discrete piece(s) of frangible plastics or bridge members. Any such ring also has protrusions on an inner side which are designed to interact with the containers thread or neck catching means, whereby the action of twisting the cap (say anticlockwise) off to open the container, causes the cap protrusions to engage the catching means on the container to break the bridge member whereby the ring from the cap is left behind on the container thread or neck.

The action of the 'catching' can be done in many different ways such as by ratchet type protrusions or teeth over container pawl segments or by protrusions or rim protrusions catching a circular rim. However these methods of catching or locking are reliant on complicated injection mould tooling and maintenance to ensure the integrity of the catching. Some methods of manufacture have at least two unrelated steps that must be carried out. For example in a first step i.e. a moulding step, there is the moulding of the cap and ring in a mould in one step which can only be done having outwardly protruding protrusions or teeth and then, in a completely separate and different step, folding the ring inwardly with respect to the cap, to cause the protrusion/teeth to be located inwardly as required to lock with an external thread or neck of a container where there is the potential for the folded inward ring or teeth to fold itself outward as the cap is being removed failing to indicate that the cap has been tampered with.

This moulding step is carried out generally because it is the most efficient way to mould teeth or protrusions so that they allow one easy step to eject the moulded cap and ring out of the mould without destroying the ring and teeth. Also the folding step is difficult to carry out correctly and so must be done with precision. Another problem with this type of one step moulding is that with a worn mould or incorrect mould setup, where there is too much injection pressure used, there is a tendency for the plastic to flash across the discrete piece (s) or frangible bridge members, in effect this causes the ring that is to break away from the cap to be joined as part of the cap and can not break off so the TEC looses the ability to show that the cap has been removed.

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

OBJECT OF THE INVENTION

It is an object of the invention, to provide tamper evident closure (TEC), apparatus for forming a tamper evident closure (TEC) and method of forming a (TEC), that ameliorates some of the disadvantages and limitations of the known art or at least provide the public with a useful choice.

SUMMARY OF INVENTION

In a first aspect the invention resides in a tamper evident closure (TEC) including a closure cap and at least one tamper evident ring forming a recessed space therein whereby the at least one tamper evident ring has a body with one end attached by at least one frangible bridge member to the cap, whereby the at least one ring includes at least one protrusion member spaced there around such that the protrusion members are formed by being stamped and protrude into the recessed space.

Preferably the at least one tamper evident ring is formed with an inner ring member and an outer ring member, whereby the inner ring member includes the least one protrusion thereon.

Preferably, the tamper evident ring has a cross section formed by a base portion joining the inner and outer ring members whereby the base portion is joined to the bridge members.

Preferably, the tamper evident ring cross section is substantially V shaped or U shaped.

Preferably, each protrusion member comprises a continuous ring shaped protruding ridge.

Alternatively, the protrusion member comprises at least two members in the shape of a curved member.

Alternatively, the protrusion member is angular shaped to form a ledge-like member.

Preferably, there are a plurality of protrusion members.

In a second aspect the invention resides in a protrusion member forming apparatus for forming protrusion members in a tamper evident closure, the tamper evident closure including a closure cap and at least one tamper evident ring forming a recessed space therein whereby the at least one tamper evident ring has a body with one end attached by at least one frangible bridge member to the cap, whereby the at least one tamper evident ring includes at least one protrusion member spaced there around such that the protrusion members are formed by being stamped and protrude into the recessed space, the at least one tamper evident ring is formed with an inner ring member and an outer ring member, whereby the inner ring member includes the least one protrusion thereon, the protrusion member forming apparatus including a base end and forming end, and the forming end comprising shaped protuberances which during use causes a stamping or deforming action with respect to a holding action on an inner ring member and outer ring member of a tamper evident ring of a tamper evident closure, to form the protrusion members in the inner ring member wherein the protrusion member forming apparatus comprises an inner apparatus member and outer apparatus member whereby the inner apparatus member is slidably and operatively located and connected within the outer apparatus member.

Preferably, the protrusion member forming apparatus is substantially tubular in shape whereby the outer apparatus member includes a cylindrical shape with a hollow central portion to allow the inner apparatus member to slide therein.

Preferably, the inner apparatus member includes a cylindrical body comprising a cylindrical portion at a non forming end and protruding protuberances at a forming end, the cylindrical portion ending at the forming end as a floor, with the protuberances circumferentially protruding from the floor to form a recessed area whereby the floor has peripheral slots sized and shaped to allow the inner apparatus member protuberances to slide past the other protuberances of the outer apparatus member.

Preferably the outer apparatus member includes a cylindrical body comprising a first cylindrical portion having shoulders located at a non forming end, to provide stopping means and a second cylindrical portion located at a forming end, the body including a cylindrical distal end forming an enclosed space therein, and elongate protuberances which are located and spaced circumferentially within the cylindrical distal end whereby the cylindrical distal end is shaped to in use be located between the inner and outer ring members.

In a third aspect the invention resides in a method of forming a tamper evident closure TEC which includes a closure cap and at least one tamper evident ring forming a recessed space therein whereby the tamper evident ring has a body with one end attached by at least one frangible bridge member to the cap, and the ring body comprising an inner ring member and an outer ring member whereby the inner ring includes at least one protrusion member spaced there around such that the protrusion members are formed by being stamped and protrude into the recessed space and a protrusion member forming apparatus having a inner apparatus member and outer apparatus member wherein the method includes the following steps of:

forming a closure cap and ring joined by at least one frangible bridge member with the ring including an inner ring member and outer ring member joined to a base which is joined to the said at least one bridge member;

slidably fitting the inner and outer apparatus members of the protrusion member forming apparatus, to the recessed space of the cap and ring, by having the outer ring member located between the inner apparatus member and outer apparatus member;

sliding the inner apparatus member with respect to the outer apparatus member to cause the protuberances to deform the inner ring member of the tamper evident ring to form the protrusion members.

Preferably the forming step can include having the tamper evident ring being formed with cuts or some deforming detail and then carrying out the deforming step.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

BRIEF DESCRIPTION

The invention will now be described, by way of example only, by reference to the accompanying drawings:

TEC (Tamper Evident Closure)—Before Protrusion Members are Formed

FIG. 1 is a top plan end view of the TEC of the invention before being formed.

FIG. 2 is a sectional view A-A of the TEC of FIG. 1.

FIG. 3 is a perspective view of the TEC of FIGS. 1 & 2.

Container for Use With a TEC

FIG. 4 is a top plan view of a container that can be used with the TEC of the invention.

FIG. 5 is a section view B-B of part of the container of FIG. 14.

FIG. 6 is a perspective view of the part of the container of FIG. 15.

Protrusion Member Forming Apparatus

FIG. 7 is a top plan view of a protrusion member forming apparatus.

FIG. 8 is a cross sectional view C-C of the protrusion member forming apparatus of FIG. 4.

FIG. 9 is a perspective view of the protrusion member forming apparatus of FIGS. 7 & 8 before deforming.

FIG. 10 is a section D-D of the forming apparatus of FIG. 7 after deforming.

FIG. 11 is a perspective view of the protrusion member forming apparatus of FIGS. 7 & 8 after deforming.

Components of the Forming Apparatus

FIG. 12 is a top plan view of the inner apparatus portion of the forming apparatus.

FIG. 13 is a section E-E of the inner apparatus portion.

FIG. 14 is a perspective view of the inner apparatus portion.

FIG. 15 is a top plan view of the outer apparatus portion of the forming apparatus.

FIG. 16 is a section view F-F of the outer apparatus portion.

FIG. 17 is a perspective view of the outer apparatus portion.

Protrusion Member Forming Apparatus and TEC

FIG. 18 is a top plan rear end view of the protrusion member forming apparatus of FIGS. 7-8.

FIG. 19 is sectional view G-G of the protrusion member forming apparatus in place with the TEC, before use.

FIG. 20 is a top plan rear end view of the protrusion member forming apparatus when deforming an inner ring.

FIG. 21 is a sectional view H-H of the apparatus and TEC after deforming

Container and TEC

FIG. 22 is a top plan view of a container and TEC combination.

FIG. 23 is a section I-I of the combination of FIG. 22.

FIG. 24 is a top plan view of a second version TEC.

FIG. 25 is a section view J-J of the TEC of FIG. 24.

FIG. 26 is a perspective view of the TEC of FIGS. 24 & 25.

Deformed TEC

FIG. 27 is a top plan view of one form of TEC—a curved version.

FIG. 28 is a section K-K of the curved TEC of FIG. 27.

FIG. 29 is a perspective view of the TEC of FIGS. 27 & 28.

DESCRIPTION OF DRAWINGS

The following description will describe the invention in relation to preferred embodiments of the invention, namely a tamper evident closure (TEC), method of manufacture and apparatus for forming the tamper evident closure. The invention is in no way limited to these preferred embodiments as they are purely to exemplify the invention only and that possible variations and modifications would be readily apparent without departing from the scope of the invention.

Tamper Evident Closure, Container FIGS. 1-6

Figure 3:
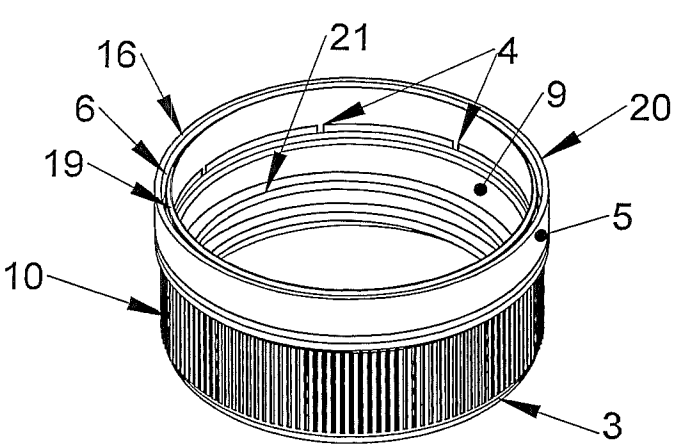
As shown in FIGS. 1-29 there is shown a tamper evident closure (TEC) 1 and a protrusion forming apparatus for forming the tamper evident closure 1. The tamper evident closure 1 includes a closure cap 3 joined by at least one frangible bridge member 4 to at least one tamper evident ring 5. The TEC has a body shape forming an enclosed recessed space 6 whereby there is a cap end 7 and ring end 8, and an inner surface 9 and outer surface 10. The terms outer and inner are therefore made in reference to the recessed space 6.
Figure 1:
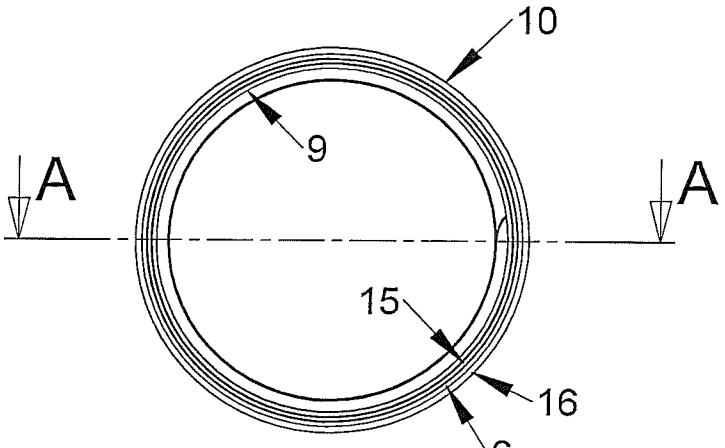
Figure 2:
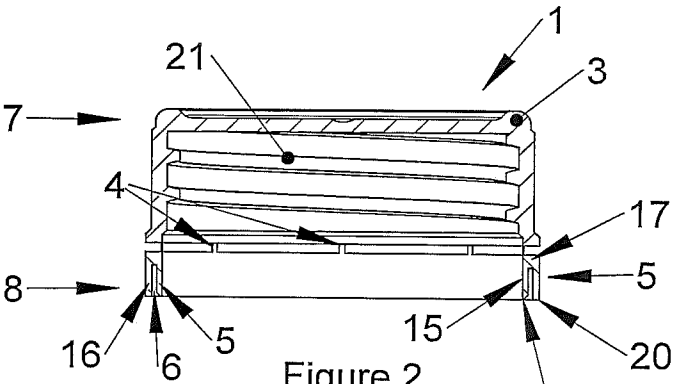

The tamper evident ring 5 includes or is first formed, having an inner ring member 15 and an outer ring member 16 joined by a base portion 17 to give an approximate shape in cross section of a V or U shape (see FIGS. 2 & 28) and in plan view being of a similar extent to the closure cap i.e. is substantially circular in shape. In this shape, both inner and outer ring members 15 & 16 are planar but curved to be ready for forming protrusions 18 therein or thereon inner ring member 15. Protrusions 18 are seen more clearly in FIGS. 22-29.

Protrusions 18 are formed in the inner ring member 15 to function as locking means to enable the TEC to be locked onto a container. Inner ring member 15 has a distal end edge 19 and outer ring member has a distal end edge 20. Protrusion 18 has a ledge-like shape with a horizontal stop surface 18*a* at the top with the base dropping away to meet the rest of the inner surface of the inner ring member 15.

Figure 6:
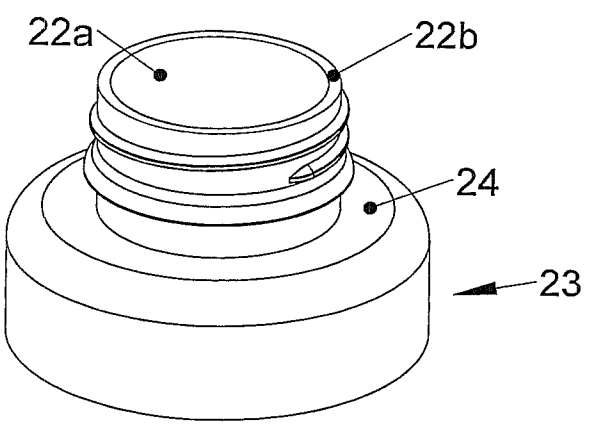
Figure 4:
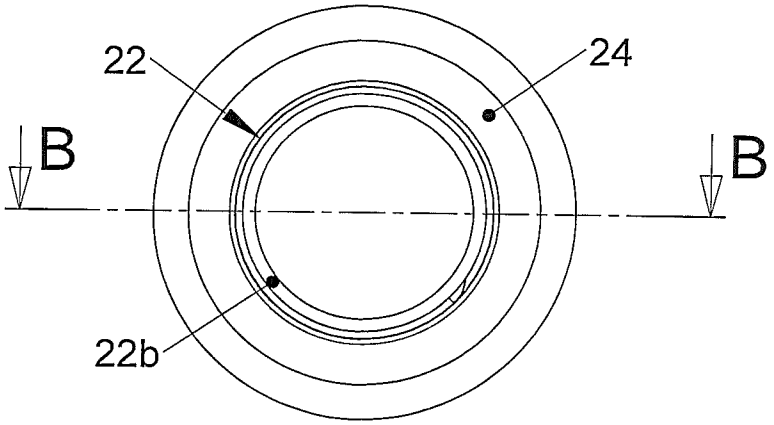
Figure 5:
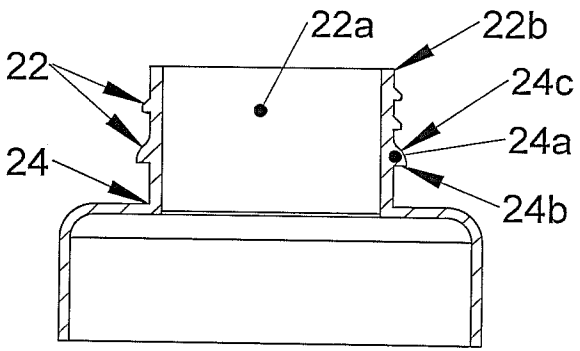

The TEC also has a thread 21 located on inner surface 9 which is adapted and shaped to slidably thread with a mating thread 22 externally mounted on a neck 22*a* of a container 23 (see FIGS. 4-6). Neck 22*a* also has an in use top edge 22*b*. Additional to the mating thread 24 on the outer surface of the container neck there is also a ring-like formation 24*a* provided at a lowest extent of the neck when in use on the container. Ring-like formation 24*a* includes a rib shape having a bottom stop surface 24*b* facing a container shoulder 24*c*. Bottom surface 24*b* can be angled at right angles to an outer vertical surface of the neck 22*a* to be essentially horizontal.

Protrusion Forming Apparatus—FIGS. 7-17

FIGS. 7-17 show one example of a protrusion forming apparatus 25 which functions to form the protrusions 18 on the inner ring member 15. Typically though not shown in this specification, the forming apparatus 25 will have suitable means to enable it to operatively function as envisaged such as other supporting structure and activating means such as power.

The protrusion forming apparatus 25 comprises at least one member that is formed and adapted to be able to move to stamp or deform using at least one protuberance to form at least one protrusion 18 (see FIGS. 24-26) in or on a tamper evident ring. The member includes a cylindrical body including an inner apparatus member 26 slidably and operatively mounted within an outer apparatus member 27 as shown in FIGS. 7-21.

Figure 14:
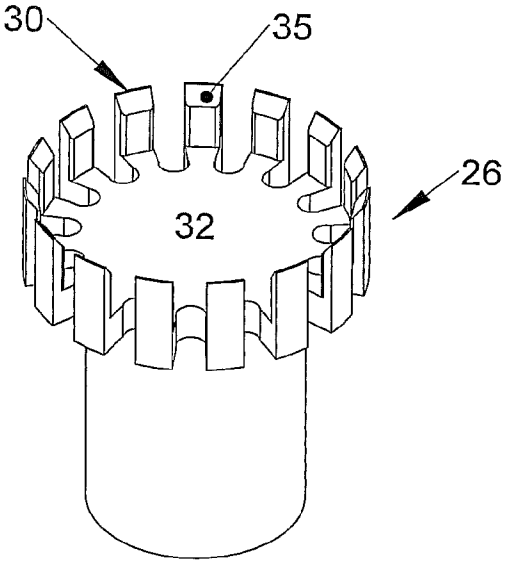
Figure 12:
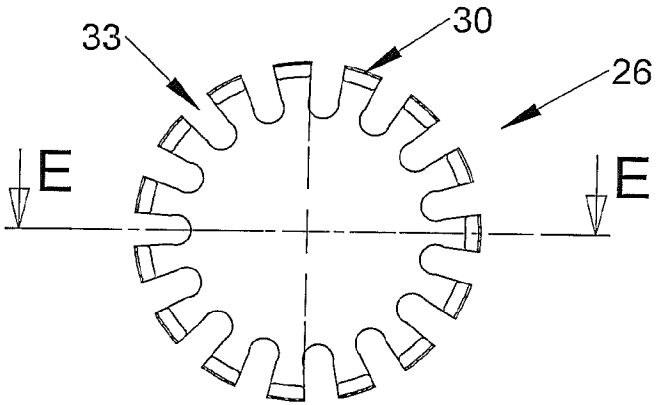
Figure 13:
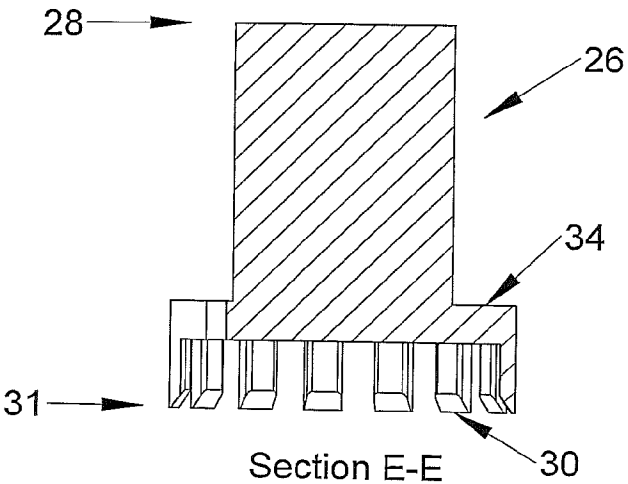

The inner apparatus member 26 includes a generally cylindrical body comprising a cylindrical portion at a non-forming end 28 and protruding protuberances 30 at a forming end 31, the cylindrical portion ending at the forming end 31 as a floor 32. Protuberances 30 circumferentially protrude upwardly in a circumferentially spaced manner from the floor 32 to form a recessed floor area whereby the floor 32 has peripheral slots 33 radially angled to space the protuberances circumferentially around the floor 32 and sized and shaped to allow the inner apparatus member protuberances 30 to slide past the outer apparatus member 27. Protuberances 30 protrude or extend both vertically and laterally as shown in FIGS. 12-14 forming a shoulder 34 extending radially beyond the cylindrical portion. Each protuberance 30 is shaped as an elongate rectangular member having a top or distal end 35 which is shaped as an angle face similar to a wedge and being inwardly and downwardly angled towards the floor 32—still almost in a vertical orientation. The cylindrical portion can be solid or hollow as required and is fabricated from polished steel or stainless steel.

Figure 17:
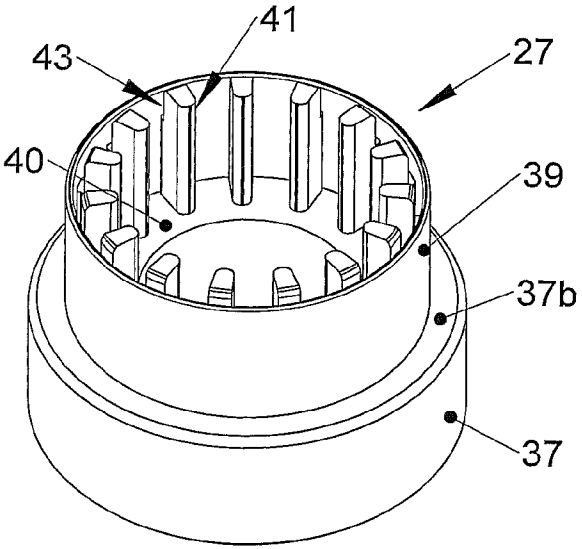
Figure 15:
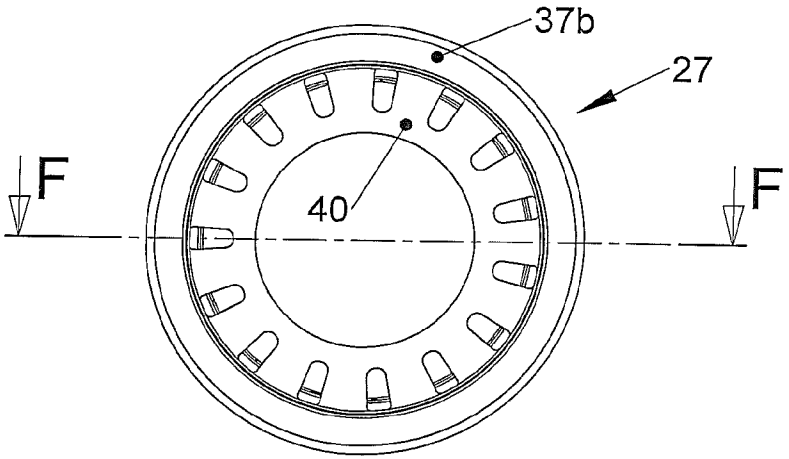
Figure 16:
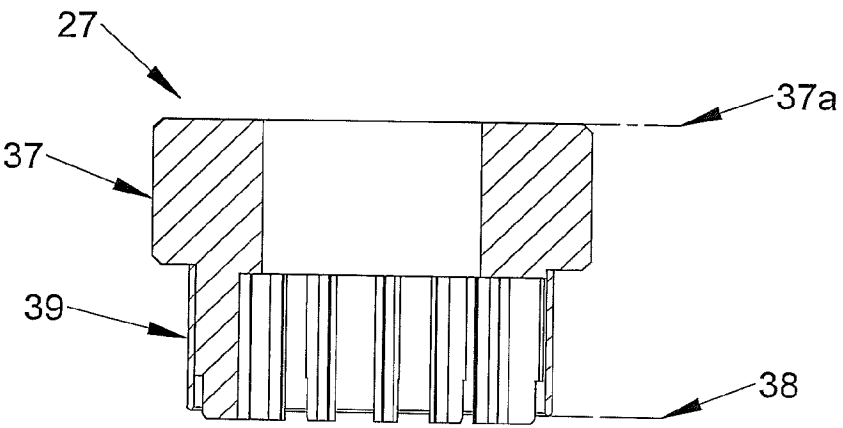

FIGS. 15-17 separately show the outer apparatus member 27 which includes a cylindrical body which is at least partially hollow and comprises a first cylindrical portion 37 at a non forming end 37*a* having a certain diameter to provide stopping means. At a forming end 38 of the body there is a second cylindrical portion 39 of a diameter less than the other diameter at the non forming end. The difference in diameter, means that the first cylindrical portion 37 forms an inwards shoulder 37*b* with respect to the other cylindrical portion 39. Also the shoulder 37*b* also extends inwardly to form an inner ledge 40 within a recess within the second cylindrical portion 39.

Located on the ledge 40 in the recess and attached to an inner wall surface of the cylindrical portion 39 there are/is an elongate protuberances 41 which are located and spaced circumferentially within the cylindrical distal end whereby the cylindrical distal forming end is shaped to in use be located between the inner and outer ring members. The protuberances 41 are shaped in cross section as a rounded or multifaceted rectangle shaped as columns with a back wall mainly attached to the inner wall surface. A portion of the back wall is not attached to the inner wall to provide a slot 43 there between. These protuberances 41 are spaced circumferentially to point radially inwardly. A distal end or top end of the protuberances does not protrude above an end of the wall and a distal portion of the back of the protuberances are not attached to the inner wall surface but form a slot like recess there between.

Figure 9:
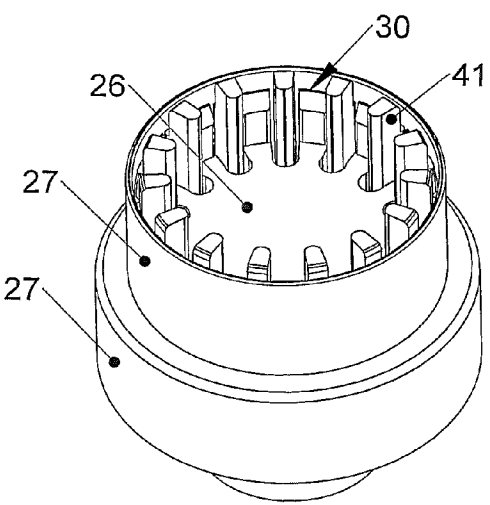
Figure 7:
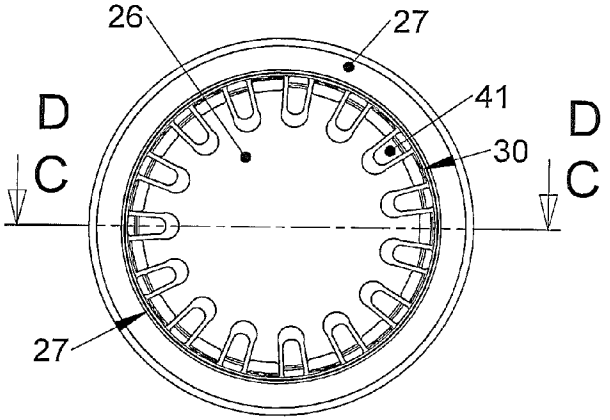
Figure 8:
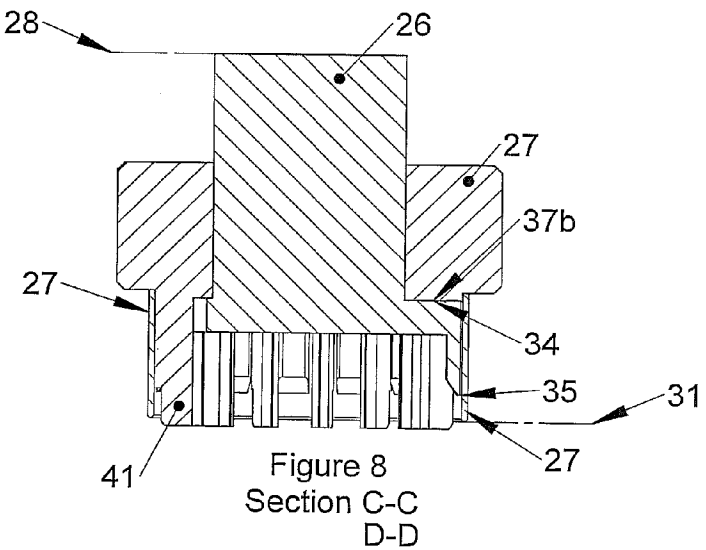
Figure 11:
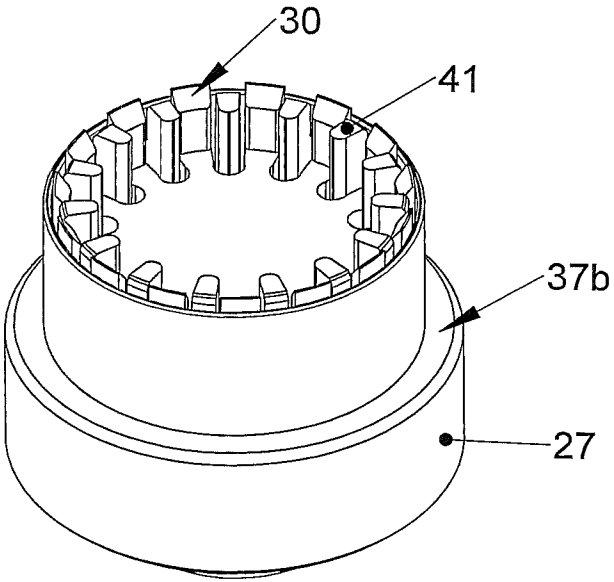
Figure 10:
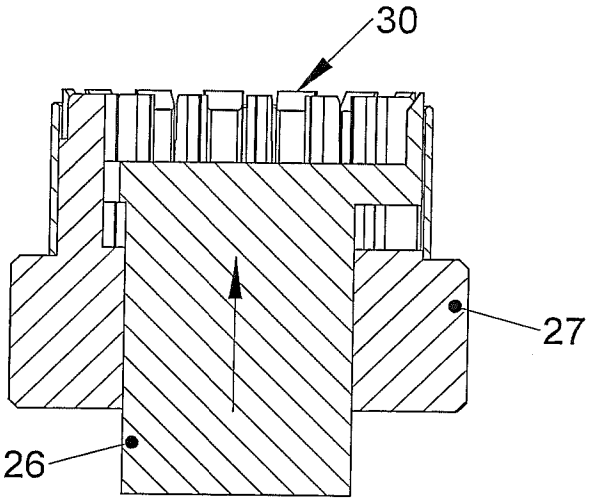

As in FIG. 7-9 the interrelationship of the inner apparatus member 26 and the outer apparatus member 27 is shown whereby the inner apparatus member 26 is slidably mounted within the outer apparatus member 27 to cause the inner apparatus member 26 to move with respect to the outer apparatus member 27—see FIGS. 10 & 11. As a combination of protuberances 30 and 41 there is a pattern of alternating protuberances with there being protuberance 30 then 41 then 30 and so on. Outer protuberances 41 of the outer apparatus member 27 move within the slots 33 of the inner apparatus member 26. The slots 33 are dimensioned to allow plenty of space or room to move in between. Inner member protuberances 30 move past the outer member protuberances 41 of the outer member 26 to then protrude as seen FIGS. 10 and 11.

Method as shown in FIGS. 18-23

Figure 18:
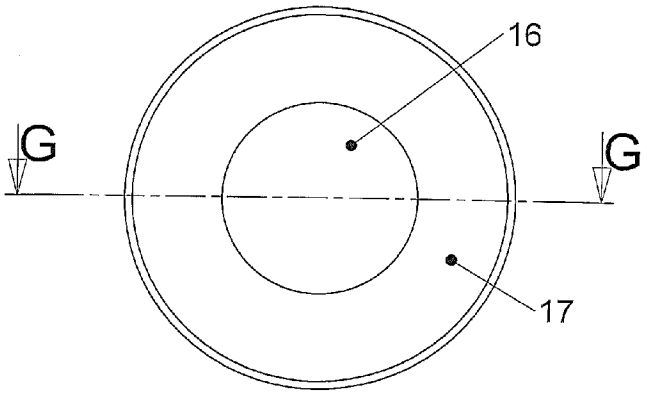
Figure 19:
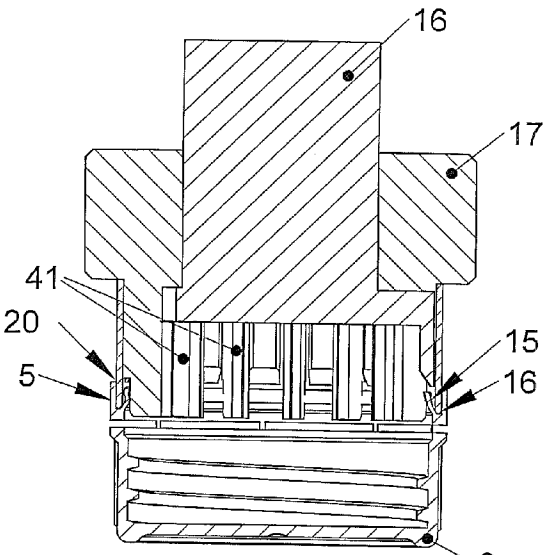

As a method of forming a tamper evident closure TEC which includes a closure cap and tamper evident ring forming a recessed space therein whereby the tamper evident ring has a body with one end attached by at least one frangible bridge member to the cap, and the ring body comprising an inner ring member and an outer ring member whereby the inner ring member includes at least one protrusion member spaced there around such that the protrusion members are formed by being stamped and protrude into the recessed space and a protrusion member forming apparatus having a inner apparatus portion and outer apparatus portion wherein the method includes the following steps of:

forming (e.g by moulding) a closure cap 3 with a tamper evident ring 5 joined by at least one frangible bridge 4 member with the ring 5 including an inner ring member 15 and outer ring member 16 joined to a base 17 which is joined to the said at least one bridge member 4 wherein the forming step can include having the ring being formed with cuts or some deforming detail and then carrying out the deforming step;

assembling as seen in FIGS. 7-9, the protrusion forming apparatus by slidably assembling the inner 26 and outer 27 apparatus members together having alternating protuberances 30 and 41;

sliding as shown in FIGS. 18 & 19, the protrusion member forming apparatus, into the recessed space of the cap 3 and ring 5, by having the cylindrical wall of the outer apparatus member 27 located between the inner ring members 15 and outer ring member 16, also the tops 35 of the protuberance 30

Figure 20:
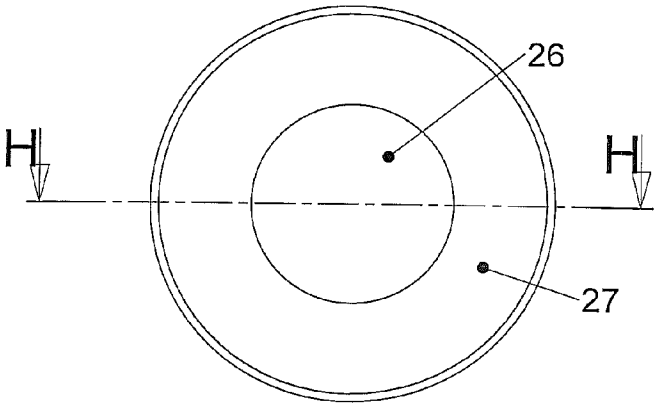
Figure 21:
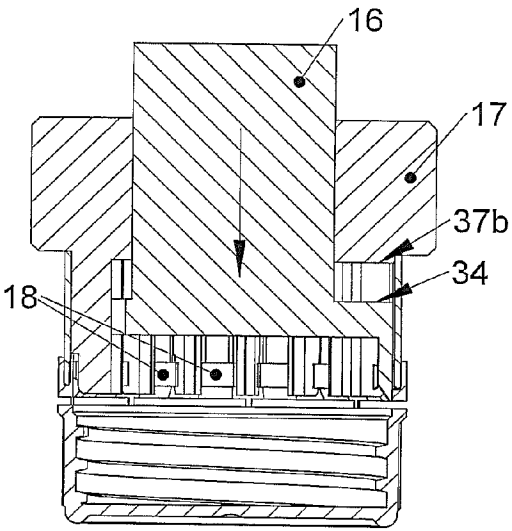
Figure 22:
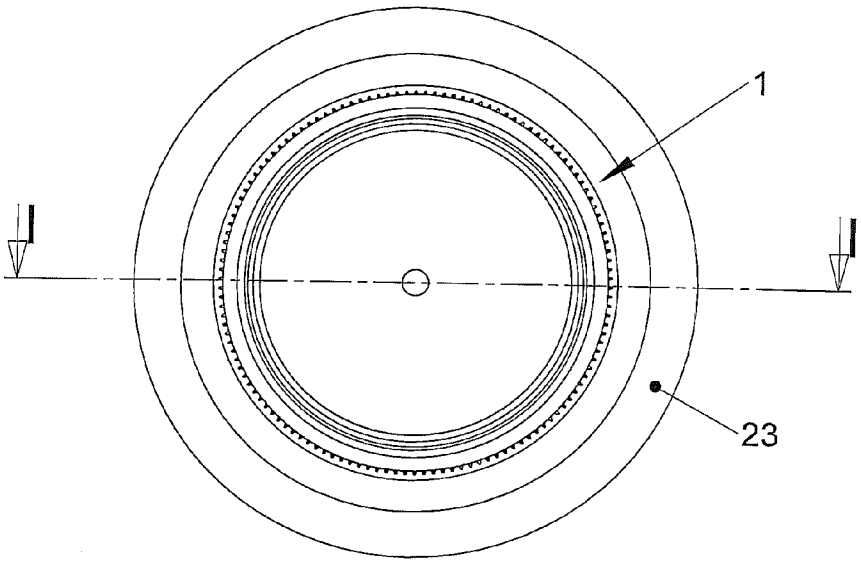

(of the Inner apparatus member 26) meets or abuts the top edge 19 of the inner ring member 15 and the inner ring member is slid into slot 43 of the outer apparatus portion 27;

as seen in FIGS. 20 and 21, next while the inner ring member 15 is held in the slot 43, the inner apparatus member 26 is pushed or stamped with respect to the outer apparatus member 27, to cause the protuberances 30 to slide down the outer wall of the inner ring member 15 to deform the inner ring member and as protuberances 30 of the forming apparatus continues to move forward they cut through inner ring member 15 and pass through the wall of 15 to form the inwardly facing protrusions 18 spaced there around. These protrusions 18 are formed as cut depressions in the material of the inner ring member as shown in FIGS. 21, 27-29.

Figure 23:
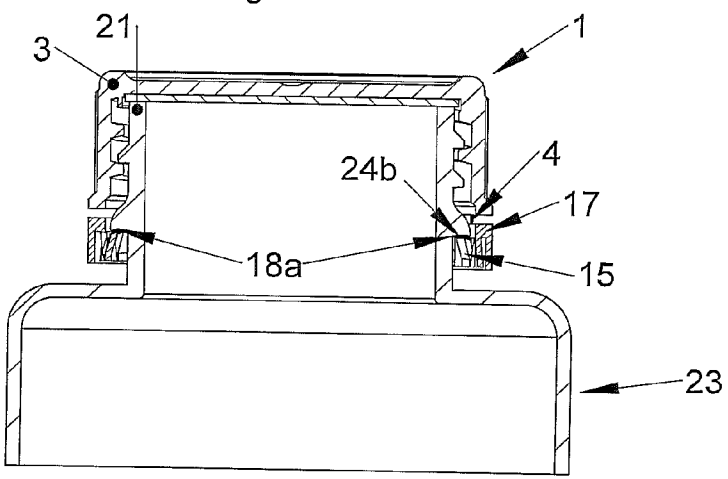

FIG. 23 shows the TEC after being installed or screwed in a clockwise direction so that the top or upper surface 18*a* of each protrusion 18 ends up opposite surface 24*b* then when the TEC is unscrewed anticlockwise the upper surface 18*a* of each protrusion 18 abuts the stop surface 24*b* on the ring-like member 24*a* as located on the outside surface of the neck of the container. This means that when the TEC is unscrewed the frangible bridge members 4 are fractured and broken separating cap 3 and ring 5 leaving ring 5 behind on the container.

Example TECs—FIGS. 24-29

Figure 26:
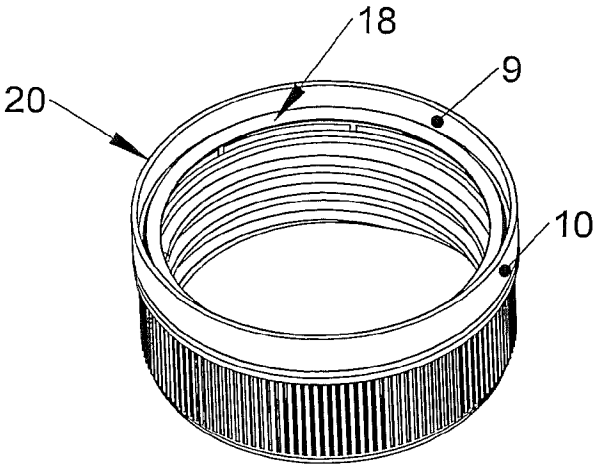
Figure 24:
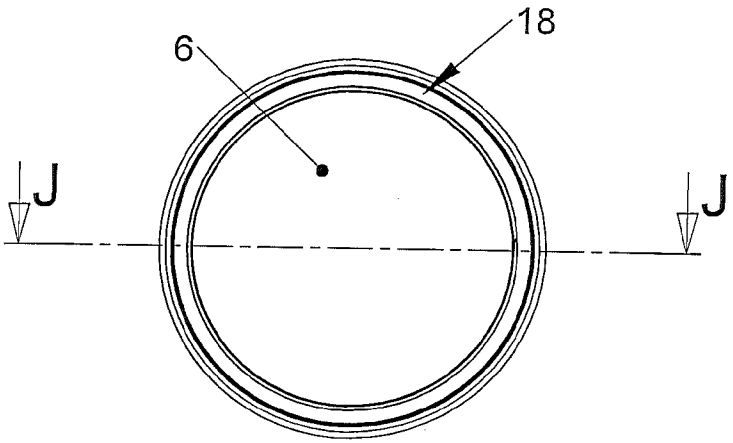
Figure 25:
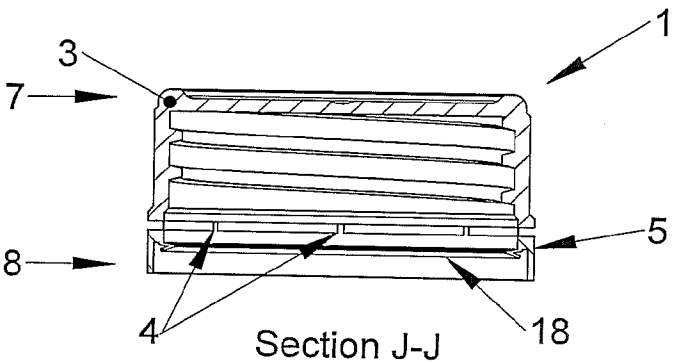
Figure 27:
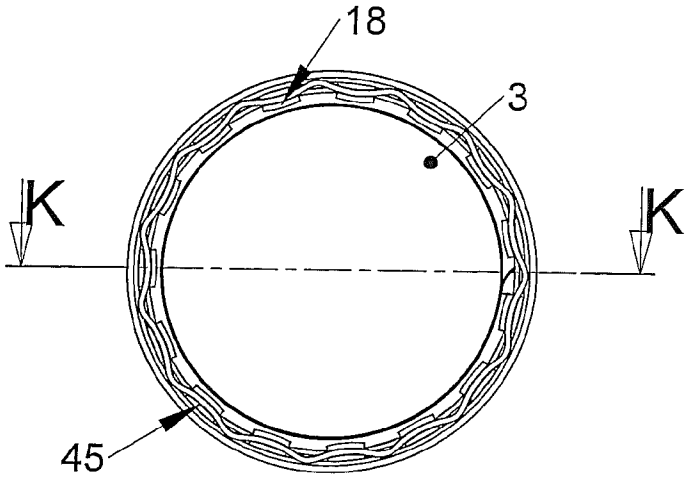
Figure 28:
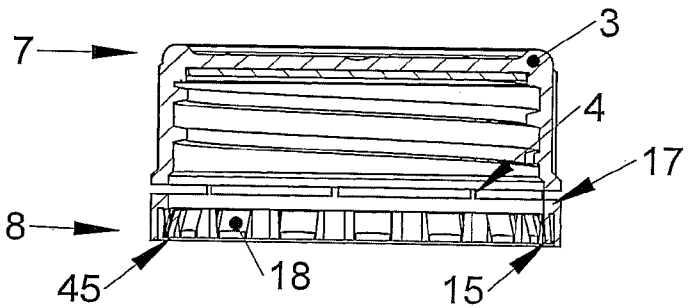
Figure 29:
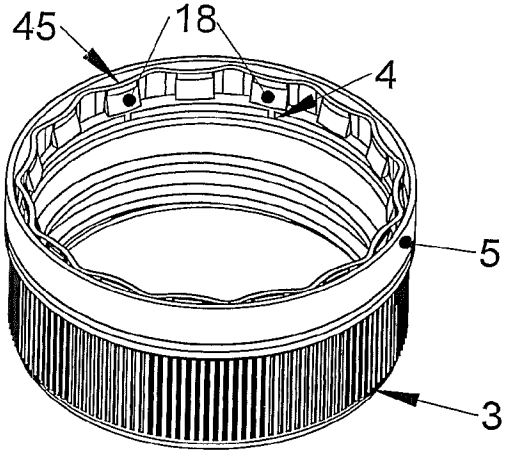

As shown in figures there can be different forms of protrusions 18 that can be produced. FIGS. 24-26 show the protrusions formed as a single continuous protrusion whereas the TEC of FIGS. 27-29 show a version having spaced protrusions 18. As shown during and after the stamping or pressing process to form the protrusions, inner ring member 15 is deformed to produce a wavy like shaped member 45 because of the holding and pressing actions on the inner ring member and outer ring member 17.

Advantages a) Simple method of manufacture b) More consistent manufacture c) More cost efficient d) No folding steps involved e) Little chance of fusion of ring with cap f) Quicker method of manufacture g) Bridge forming device h) Forming tool can be easily modified to suit different applications.

i) There is no folding parts that can fold back causing failure.

j) More secure TEC.

Variations

Throughout the description of this specification, the word "comprise" and variations of that word such as "comprising" and "comprises", are not intended to exclude other additives, components, integers or steps.

The cap can be of any shaped provided that a ring can be attached thereto. As shown in the drawings there can be several bridge members or as many as required. Other features of caps in general though not shown can also be combined such as gaskets and tear tabs. There can also be any number of rings whereby there is at least one ring as long there is one to enable the apparatus to form the protrusions thereon.

It will also be understood that where a product, method or process as herein described or claimed and that is sold incomplete, as individual components, or as a "kit of Parts", that such exploitation will fall within the ambit of the invention.

The protrusions 18 (especially seen in FIGS. 22-29) of inner ring member 15 can be of any shape that is able to be stamped or depressed or pushed out of the material of the inner ring member 15. The inner ring member 15 can also be cut or not cut as required but still be depressed. The spacing of the protuberances 18 and their sizing can be altered. Another option is for the depression to comprise a single depression circumferentially all around as shown in FIGS. 19-21.

The deforming or stamping process is not limited to one operation whereby there can be a cutting step as well as the deforming step. The ring 5 can be cut in one first operation then stamped or deformed in a secondary or multiple operations. The ring can be formed or moulded with cuts or some detail and then deformed or pushed after the moulding step to achieve the same result with on cutting.

The protrusion member forming apparatus in some cases may not need all of the protrusions 30 and 41 as shown to deform or stamp the tamper evident ring 5 as seen on FIGS. 24-26.

The inner and outer apparatus members 26 & 27 of the protrusion member forming apparatus in some cases can be formed as a one piece member having one or more protrusions 30 and 41 as required which can still cause the stamping formation of the protrusions 18.

The thread on the container neck and on the TEC can be shaped as requires in that the sized and spacing can be varied.

There also may be situations were the TEC may have no thread.

There may be situations where the cap may be a different shape, for example a square shape with no thread but an application were the TEC is a square push on closure with a square shaped tamper ring but has all the same features of the round TEC for the creation of the tamper evident ring keeping within the scope of the invention.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

These and other features and characteristics of the present invention, as well as the method of operation and functions of the related elements of structures and the combination of parts and economics of manufacture, will become more apparent upon consideration of the following description with reference to the accompanying drawings, all of which form part of this specification, wherein like reference numerals designate corresponding parts in the various figures.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However it is to be understood that the invention may assume various alternative variations, except where expressly specified to the contrary. It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

What I claimed is:

1. A tamper evident closure (TEC) comprising a closure cap and at least one tamper evident ring forming a recessed space therein wherein the at least one tamper evident ring has a body with one end attached by at least one frangible bridge member to the cap, wherein the at least one tamper evident ring is formed with an inner ring member and an outer ring member defining said recessed space therebetween and wherein the inner ring member includes at least one protrusion member thereon, such that the at least one protrusion member is formed by being stamped and protrudes into the recessed space, wherein said at least tamper evident one ring has a cross section formed by a base portion joining the inner and outer ring members whereby the base portion is joined to the at least one frangible bridge member wherein the inner and outer ring members extend from the base portion downwardly from said base portion toward a container when the closure cap is in place on said container.

2. The tamper evident closure as claimed in claim 1 wherein, the ring cross section is substantially inverted V shaped or inverted U shaped.

3. The tamper evident closure as claimed in claim 2 wherein, said at least one protrusion member comprises a continuous ring shaped protruding ridge.

4. The tamper evident closure as claimed in claim 2 wherein, the protrusion member comprises at least two members in the shape of a curved member.

5. The tamper evident closure as claimed in claim 2 wherein, the protrusion member is angular shaped to form a ledge-shaped member.

6. The tamper evident closure as claimed in claim 2 wherein, there are a plurality of protrusion members.

7. A tamper evident closure (TEC) comprising a closure cap and at least one tamper evident ring, wherein the at least one tamper evident ring is attached to the closure cap at one end by at least one frangible bridge member, the at least one tamper evident ring comprising an inner ring member and an outer ring member, the inner ring member comprising at least one protrusion member that projects radially inwardly of the inner ring member, wherein said inner and outer ring members are interconnected at first ends thereof that are proximate to the closure cap and wherein each of said inner and outer ring members terminates downwardly in a respective free edge formed at a corresponding second end thereof that is distal to the closure cap.

8. The tamper evident closure as claimed in claim 7, wherein the at least one tamper evident ring has a cross section is substantially inverted V shaped or inverted U shaped.

9. The tamper evident closure as claimed in claim 7, wherein said at least one protrusion member comprises a continuous ring-shaped protruding ridge.

10. The tamper evident closure as claimed in claim 7, wherein said at least one protrusion member comprises at least two members in the shape of a curved member.

11. The tamper evident closure as claimed in claim 7 wherein said at least one protrusion member is angled to form a ledge-shaped member.

* * * * *